United States Patent [19]

Wallis

[11] 3,981,371

[45] Sept. 21, 1976

[54] CORE SAMPLING DRILL

[76] Inventor: Jamie Malcolm Wallis, Morrison Road, Midvale, Western Australia, Australia

[22] Filed: June 6, 1975

[21] Appl. No.: 584,491

[52] U.S. Cl. ..... 175/403; 175/60

[51] Int. Cl.[2] ..... E21B 49/00

[58] Field of Search ..... 175/60, 215, 403

[56] References Cited

UNITED STATES PATENTS

| | | | |
|---|---|---|---|
| 2,485,098 | 10/1949 | Johnson | 175/60 X |
| 3,208,538 | 9/1965 | Pitcher | 175/215 X |
| 3,331,455 | 7/1967 | Anderson, Jr. et al. | 175/403 |
| 3,807,514 | 4/1974 | Murrell | 175/60 X |

*Primary Examiner*—Ernest R. Purser
*Assistant Examiner*—Richard E. Favreau
*Attorney, Agent, or Firm*—Haseltine, Lake & Waters

[57] ABSTRACT

A core sampling drill comprising a drill bit having a series of cutting surfaces arranged around a central core hole, the upper end of the drill bit being threaded so that it can be fitted to the lower end of a tubular drill stem, a core tube positioned within the lower end of the drill stem substantially concentric therewith and spaced apart therefrom to provide an outer annular passage, the inner portion of the outer wall of the drill bit being provided with an annular recess which is arcuate in cross section so that air flowing downwardly through the outer annular passage is turned through approximately 180° and directed upwardly into the core tube so that the material cut by the drill bit is entrained therein and carried into the core tube.

1 Claim, 2 Drawing Figures

CORE SAMPLING DRILL

This invention relates to an improved core sampling drill.

The object of the invention is to provide a core sampling drill which will provide a reliable core or geological sample of the area being drilled.

In one form the invention resides in a core sampling drill comprising a drill bit having a series of cutting surfaces arranged around a centralcore hole, the upper end of the drill bit being threaded so that it can be fitted to the lower end of a tubular drill stem, a core tube positioned within the lower end of the drill stem substantially concentric therewith and spaced apart therefrom to provide an outer annular passage, the inner portion of the outer wall of the drill bit being provided with an annular recess which is arcuate in cross section so that air flowing downwardly through the outer annular passage is turned through approximately 180° and directed upwardly into the core tube so that the material cut by the drill bit is entrained therein and carried into the core tube.

Preferably the lower end of the core tube is flared outwardly.

The invention will be better understood by reference to the following description of one specific embodiment thereof, shown in the accompanying drawings wherein.

Figure 1:
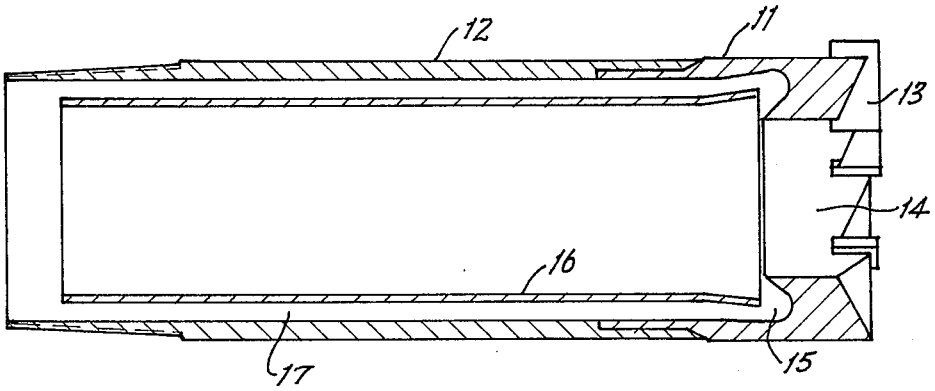
FIG. 1 is sectional elevation on line 1—1 Of FIG. 2.
Figure 2:
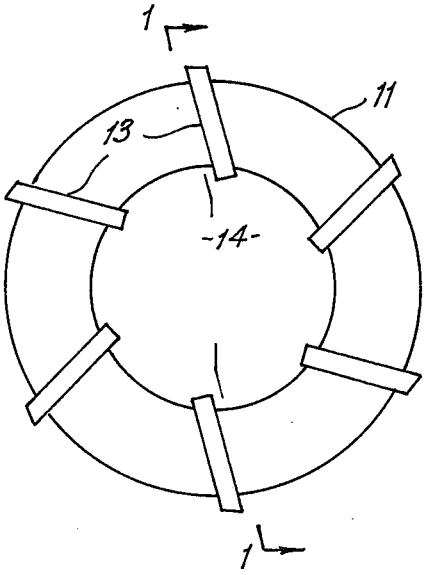
FIG. 2 is an end view of the drill bit.

As shown in the drawings the drill bit comprises a tubular body 11, the upper end of which is threaded externally so that it can be screwed into the correspondingly internally threaded lower end of a section of drill stem 12. A series of tungsten carbide cutting members 13 are arranged in spaced positions on the bottom face of the bit body so that they project downwardly therefrom. The lower portion of the bit body is provided with a central core passage 14. An annular recess 15 is formed around the top of the core passage and the recess is substantially arcuate in cross section. A core tube 16 is positioned within the lower end of the drill stem so that its lower end projects into the upper end of the drill body and terminates above the recess 15. Preferably the lower end of the core tube is flared outwardly. The core tube is of smaller diameter than the drill stem and is held concentric therewith by spacers (not shown) to form an annular air passage 17 between the outer wall of the core tube and the inner wall of the recess.

During drilling air is directed down the drill stem and passes through the annular air passage 17. The material cut by the cutting members 13 passes through the core passage 14 and is entrained in the air flowing upwardly through the core tube 16 after it has been turned through approximately 180° by the recess 15.

I claim:

1. A core sampling drill comprising a drill bit having a lower end with a series of cutting surfaces arranged around a central core hole, the upper end of the drill bit being threaded so that it can be fitted to the lower end of a tubular drill stem, a core tube positioned within the lower end of the drill substantially concentric therewith and spaced apart therefrom to provide an outer annular air passage, the inner portion of the outer wall of the drill bit being provided with an annular recess which is arcuate in cross-section so that air flowing downwardly through the outer annular passage is turned through approximately 180° and directed upwardly into the core tube so that the material cut by the drill bit is entrained therein and carried into the core tube, said core tube being substantially cylindrical over its entire length and including a lower end portion which is conically flared and has an end extremity immediately proximate said annular recess and facing radially thereto.

* * * * *